US009321058B2

(12) United States Patent
Kopper et al.

(10) Patent No.: US 9,321,058 B2
(45) Date of Patent: Apr. 26, 2016

(54) CENTRIFUGAL LIQUID SEPARATION MACHINE TO EFFICIENTLY FLOW MULTI-PHASE SOLIDS FROM A HEAVY PHASE DISCHARGE STREAM WITH A SOLIDS PLOW

(75) Inventors: Michael Kopper, Beach Park, IL (US); Robert Havrin, Lake Bluff, IL (US)

(73) Assignee: CENTRISYS CORP., Kenosha, WI (US)

( * ) Notice: Subject to any disclaimer, the term of this patent is extended or adjusted under 35 U.S.C. 154(b) by 868 days.

(21) Appl. No.: 13/173,483

(22) Filed: Jun. 30, 2011

(65) Prior Publication Data

US 2012/0004088 A1 Jan. 5, 2012

Related U.S. Application Data

(60) Provisional application No. 61/360,723, filed on Jul. 1, 2010.

(51) Int. Cl.
*B04B 1/20* (2006.01)

(52) U.S. Cl.
CPC ..... *B04B 1/20* (2013.01); *B04B 1/2008* (2013.01); *B04B 2001/2041* (2013.01); *B04B 2001/2091* (2013.01)

(58) Field of Classification Search
CPC .. B04B 1/20; B04B 11/02; B04B 2001/2041; B04B 2001/2091
USPC ..... 494/1–6, 10, 23, 25, 26, 37, 53, 54, 56, 494/67; 210/380.1, 380.3
See application file for complete search history.

(56) References Cited

U.S. PATENT DOCUMENTS

| | | | | | |
|---|---|---|---|---|---|
| 1,572,612 | A | | 2/1926 | Laughlin | |
| 3,428,248 | A | | 2/1969 | Andersen et al. | |
| 3,795,361 | A | * | 3/1974 | Lee | 494/26 |
| 3,885,734 | A | * | 5/1975 | Lee | 494/25 |
| 4,245,777 | A | * | 1/1981 | Lavanchy | 494/53 |
| 4,335,846 | A | * | 6/1982 | Shapiro | 494/54 |
| 4,339,072 | A | | 7/1982 | Hiller | |
| 4,449,967 | A | | 5/1984 | Caldwell | |
| 4,790,806 | A | * | 12/1988 | High | 494/26 |

(Continued)

FOREIGN PATENT DOCUMENTS

| | | | |
|---|---|---|---|
| CN | 1646229 | A | 7/2005 |
| CN | 1809423 | A | 7/2006 |

(Continued)

*Primary Examiner* — Charles Cooley
(74) *Attorney, Agent, or Firm* — Brannen Law Office, LLC

(57) ABSTRACT

The present invention relates to a centrifugal liquid separation machine and in particular to a screw type centrifugal liquid separation machine that lifts grit and other solids from the bowl wall in a radially inward manner and resuspends the grit and other solids into the heavy phase discharge flow. According to one embodiment of the present invention, the machine has an outer bowl and a conveyor. The bowl and conveyor are coaxial, and a back drive assembly causes these components to rotate at different speeds to allow the conveyor to mechanically sweep heavy phase materials within a separation region of the machine. Grit is conveyed radially inward along a plow and tumbled into the heavy phase discharge flow, wherein it is resuspended and exits the machine with that flow. Wipers can also be provided for preventing blockage of heavy phase flow under the solids baffle.

19 Claims, 7 Drawing Sheets

(56) References Cited

U.S. PATENT DOCUMENTS

| | | | | |
|---|---|---|---|---|
| 4,818,296 | A | 4/1989 | Hejman et al. | |
| 4,898,571 | A * | 2/1990 | Epper et al. | 494/26 |
| 5,261,869 | A | 11/1993 | Caldwell et al. | |
| 5,429,581 | A | 7/1995 | Michaud et al. | |
| 5,542,903 | A | 8/1996 | Nishida et al. | |
| 5,653,673 | A | 8/1997 | Desai et al. | |
| 5,685,819 | A * | 11/1997 | Nishida et al. | 494/53 |
| 8,956,272 | B2 * | 2/2015 | Vanderbeken et al. | 494/37 |
| 8,968,169 | B2 * | 3/2015 | Eiken | 494/53 |
| 9,028,387 | B2 * | 5/2015 | Eiken | 494/2 |
| 9,044,762 | B2 * | 6/2015 | Kopper | B04B 1/20 |
| 2007/0049480 | A1 | 3/2007 | Stroucken et al. | |
| 2008/0248940 | A1 * | 10/2008 | Figgener et al. | 494/59 |
| 2011/0306485 | A1 * | 12/2011 | Kopper et al. | 494/1 |
| 2012/0004088 | A1 * | 1/2012 | Kopper et al. | 494/53 |

FOREIGN PATENT DOCUMENTS

| | | | |
|---|---|---|---|
| CN | 101391238 | A | 3/2009 |
| SU | 622502 | A1 | 7/1978 |

* cited by examiner

CENTRIFUGAL LIQUID SEPARATION MACHINE TO EFFICIENTLY FLOW MULTI-PHASE SOLIDS FROM A HEAVY PHASE DISCHARGE STREAM WITH A SOLIDS PLOW

This United States utility patent application claims priority on and the benefit of provisional application 61/360,723 filed Jul. 1, 2010, the entire contents of which are hereby incorporated herein by reference.

BACKGROUND OF THE INVENTION

1. Field of the Invention

The present invention relates to a centrifugal liquid separation machine and in particular to a screw type centrifugal liquid separation machine that lifts grit and other solids from the bowl wall in a radially inward manner and resuspends the grit and other solids into the heavy phase discharge flow.

2. Description of the Related Art

Centrifugal machines are useful in many types of applications. In one application, wastewater treatment plants, it is desired to achieve a 4% to 6% cake solids discharge. This range of cake solids is required in order for an anaerobic digester to operate efficiently. Falling below this range requires increased digester capacity. Rising above this range typically results in mixing problems due to the thickness of the heavy phase liquids. Even though the principles of the present invention are described with respect to one type of application, it is understood that the invention is in no way limited to this described application.

In the basic form, decanter type centrifugal separation machines have a rotating outer bowl, an internal screw conveyor co-axially aligned with the outer bowl, and a mechanism for maintaining a difference in speed between the rotating outer bowl and the internal screw conveyor to allow for continuous operation of the machine. Rotation of the bowl at elevated speeds results in solid liquid separation action within the separation region of the machine due to elevated levels of gravitational forces within the machine. Materials such as solids and heavier density liquid will thus settle to the outer diameter of the separation region and the lower density liquid will migrate to the inner diameter of the separation region. The separation rate increases with the elevation of gravitational forces resulting from the rotation of the bowl. The screw conveyor has a rotational speed greater or less than the rotational speed of the outer bowl. This difference in speed allows screw conveyor flights to provide a mechanical sweeping action within the separation region. Grit tends not to flow, and as such, needs to be conveyed to discharge from a decanter centrifuge. However, in a design where the solids discharge is radial and inward, this can create an accumulation problem. The accumulation of non-flowing materials can increase operational horsepower, reduce capacity and otherwise disrupt proper operation of the device. The grit also tends to grind upon parts and subject those parts to premature failure. Hence, a design adequately dealing with grit would be advantageous.

There have been many centrifuge designs over the years. A few of those designs are illustrated in the following US patents in order to illustrate to current state of centrifuge devices.

United States Patent Number (hereafter "USPN") U.S. Pat. No. 3,795,361 to Lee is titled Centrifuge Apparatus. This patent describes how a decanter centrifuge having a screw conveyor within an imperforate bowl is provided with an annular baffle carried by the screw conveyor. A heavy phase discharge port is taught to be located in a tapered portion of the bowl and is located at a greater radial distance from the rotational axis than the inner surface of the light phase material. The periphery of the baffle is closely spaced from the bowl in order to form a restricted passageway for the underflow of heavy phase material from a separating zone within the cylindrical portion of the bowl to a heavy phase discharge zone within the tapered portion of the bowl. With a conical baffle, incoming feed is directed onto the inwardly facing surface of the baffle and accelerated in order to minimize turbulence in the separating zone. The use of a tapered portion, or a beach, reduces the capacity of the machine, as shallow beach angles required to adequately convey grit or trash requires an undesirably large proportion of bowl length.

U.S. Pat. No. 4,339,072 to Hiller is titled Centrifuge for Separating Solids/Liquids Mixtures. In this invention, a centrifuge drum having an outer jacket is provided with apertures positioned in the jacket. Through the apertures at least a partial discharge of concentrated solids phase occurs thereto. A control device preferably in the form of a disk provides a surface spaced at a small interval from the apertures so as to prevent the flow of solids/liquids through the aperture except when a discontinuity such as a recess or cut-out in the surface occurs so as to allow flow through the aperture. While this patent describes a solution for eliminating a truncated cone by discharging from the outer bowl, its design is not without drawbacks. For example, it is required that all solids pass through very small nozzles. This can result in undesirable amounts of abrasive damage and plugging of the machine, especially when grit is present.

U.S. Pat. No. 5,542,903 to Nishida et al. is titled Centrifugal Liquid Separating Machine Using Deceleration Vanes. This patent teaches that discharge passages for concentrated and separated liquids are separately formed in shafts of a rotary bowl and a screw conveyor. In an inlet passage of the radial discharge passage leading from the inside of the rotary bowl to the discharge passage in the shaft, an annular space is divided into sectors by a plurality of deceleration vanes which are mounted on the screw conveyor and extend in a radial direction from the axis of the machine. While this patent shows a solution to problems with amorphous trash, is does not address the problems caused by abrasive materials such as grit.

U.S. Pat. No. 4,449,967 to Caldwell is titled Conveyor Flight Configuration. This patent shows that the blade of a helical screw conveyor of centrifuge apparatus can be improved to reduce the amount of torque required in operating the apparatus as well as to produce discharged solids drier than the solids discharged using a conventional blade. The patent teaches the improvement to be that the distal end of the leading surface of the blade at or adjacent at least the truncoconical end of the centrifuge bowl have a generally arcuate configuration concave in the direction of the solids discharge port such that the more distal blade portions peel the separated solids material from the bowl wall with minimum torque requirements, while the less distal arcuate portions tumble the solids to reduce the moisture content. Typically, the blade's arcuate leading surface is formed by add-on, wear-resistant members attached to a backing plate which in turn is mounted on the leading surface of the blade.

U.S. Pat. No. 5,653,673 to Desai et al. is titled Wash Conduit Configuration in a Centrifuge Apparatus and Uses Thereof. This patent shows a centrifugal apparatus for the continuous separation of solids-liquid mixtures and the internal washing of separated solids with one or more conduits to deliver washing liquid into centrifugally sedimented solids tumbling, which allows wash liquid to better penetrate a less compacted pile of solids. A distal end of each wash conduit is positioned in close proximity to the inner surface of the centrifuge bowl near the conveyor blade which is adapted to contact the solids upon separation and propel separated solids toward the solids discharge port. The invention includes centrifugal apparatus provided with plurality of cutting tools such as knife blades adapted to cut and separate the sedimented solids. In another aspect of the invention centrifugal apparatus is provided with one or more dip weirs dividing the centrifugally separated liquid pool in the bowl into axially adjacent zones with suitable a passageway for transfer of liquids and solids between adjacent zones. In another aspect of the invention at least a portion of the leading surface of the conveyor blade is provided with an arcuate surface portion adjacent to the distal edge thereof of defined concavity in the leading surface and shape adapted to contact the sedimented solids and tumbling them in washing liquid. This invention provides improved separation of mother liquor from discharged solids and/or reduction of washing liquid required to achieve desired purity of recovered solid product.

None of these patents teach a way to radially and inwardly lift grit and other solids from the bowl wall.

None of these patents teach a way to resuspend grit and other solids in a heavy phase discharge stream.

None of these patents illustrate wipers used to prevent plugging of a solids baffle.

Thus, there exists a need for a centrifugal liquid separation machine that solves these and other problems.

SUMMARY OF THE INVENTION

The present invention relates to a centrifugal liquid separation machine and in particular to a screw type centrifugal liquid separation machine that lifts grit and other solids from the bowl wall in a radially inward manner and resuspends the grit and other solids into the heavy phase discharge flow. According to one embodiment of the present invention, the machine has an outer bowl and a conveyor. The bowl and conveyor are coaxial, and a back drive assembly causes these components to rotate at different speeds to allow the conveyor to mechanically sweep heavy phase materials within a separation region of the machine. Grit is conveyed radially inward along a plow and tumbled into the heavy phase discharge flow, wherein it is resuspended and exits the machine with that flow. Wipers can also be provided for preventing blockage of heavy phase flow under the solids baffle. The plows can be removably inserted on the solids baffle.

According to one advantage of the present invention, the grit is conveyed radially inward. Advantageously, the material is sliced from the bowl wall due to the angle of the plow relative the held cake. In one embodiment, the shape of the plow face is arcuate, resulting in the projecting or tumbling of grit and other solids into the heavy phase discharge flow.

According to another advantage of the present invention, the machine operates with less power consumption because of decreased torque requirements. Slicing angles are effective at angles greater than 15 to 25 degrees, work more efficiently at 25 to 45 degrees and work most efficiently between angles of 45 to 80 degrees. The solids which are propelled onto the surface of the blade show reduced torque as their weight contributes much less to the frictional drag forces pushing the pile of solids along the helix. Also, elimination of the accumulation of grit along the axial conveyance path eliminates grit build up, which can cause severe wear at the contact points.

According to a further advantage of the present invention, the grit, once conveyed radially inward, is tumbled into the heavy phase flow wherein it is resuspended within the flow and can be transported out of the machine.

According to a still further advantage of the present invention, a restriction in the heavy phase liquid flow path will increase the velocity of the flow at the point where solids tumbling from the plow occurs. Further, resuspending the solids at a radially inward location reduces the gravitational forces acting upon them.

According to a still further advantage yet of the present invention, the plows can be integrated with the solids baffle and extend behind the solids baffle. This feature promotes the entrainment of solids into the heavy phase liquid flow.

According to a still further advantage yet of the present invention, wipers are provided to prevent blockage of the solids baffle that could prevent heavy phase liquid flow.

According to another advantage of the present invention, removable inserts can be provided for the plow having special wear characteristics.

According to still further advantage yet of the present invention, the pool depth can be increased and the overall machine capacity can be increased due to elimination of the need to have a solids beach.

Other advantages, benefits, and features of the present invention will become apparent to those skilled in the art upon reading the detailed description of the invention and studying the drawings.

DETAILED DESCRIPTION OF PREFERRED EMBODIMENTS

While the invention will be described in connection with one or more preferred embodiments, it will be understood that it is not intended to limit the invention to those embodiments. On the contrary, it is intended to cover all alternatives, modifications and equivalents as may be included within the spirit and scope of the invention as defined by the appended claims.

Figure 1A:
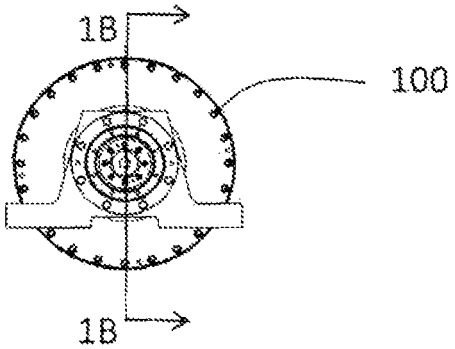
FIG. 1A is an end view of an embodiment of the machine of the present invention.
Figure 2:
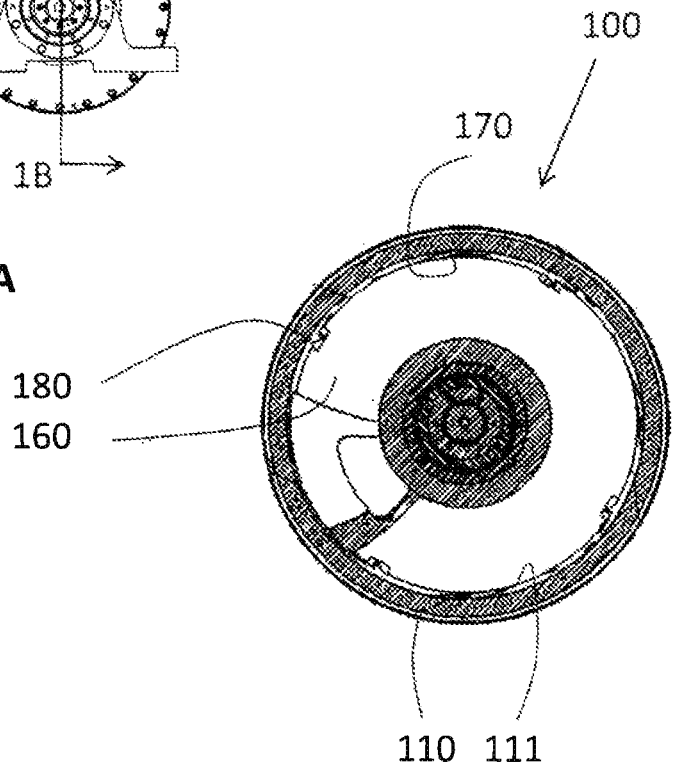
FIG. 2 is a cross-sectional view taken along line 2-2 in FIG. 1B.
Figure 1B:
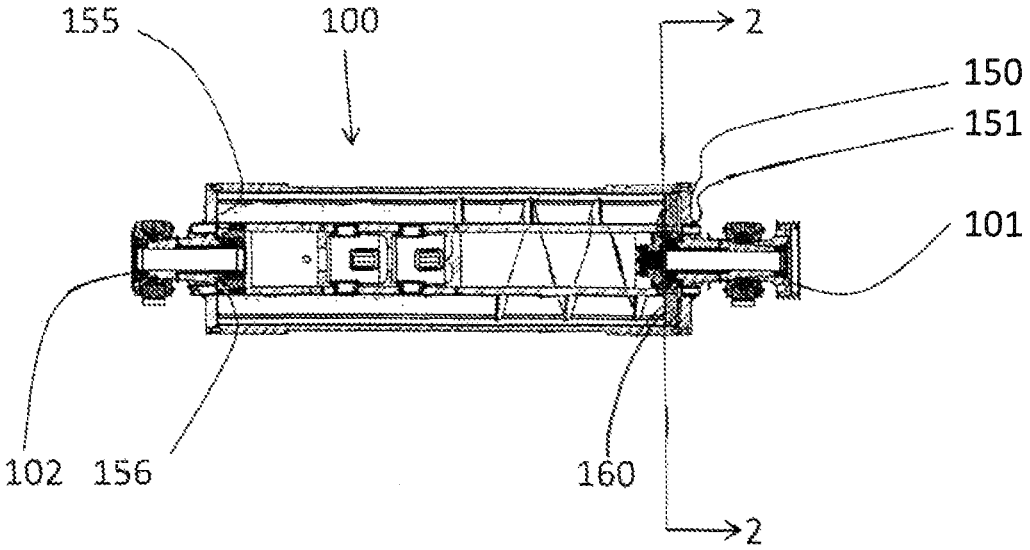
FIG. 1B is a cross-sectional view taken along line 1B-1B in FIG. 1A.

Turning now to FIG. 1, it is seen that a machine 100 is provided. The machine 100 has opposed ends 101 and 102. In practice end 101 is commonly referred to as the back drive end and end 102 is commonly called the feed end.

Figure 7:
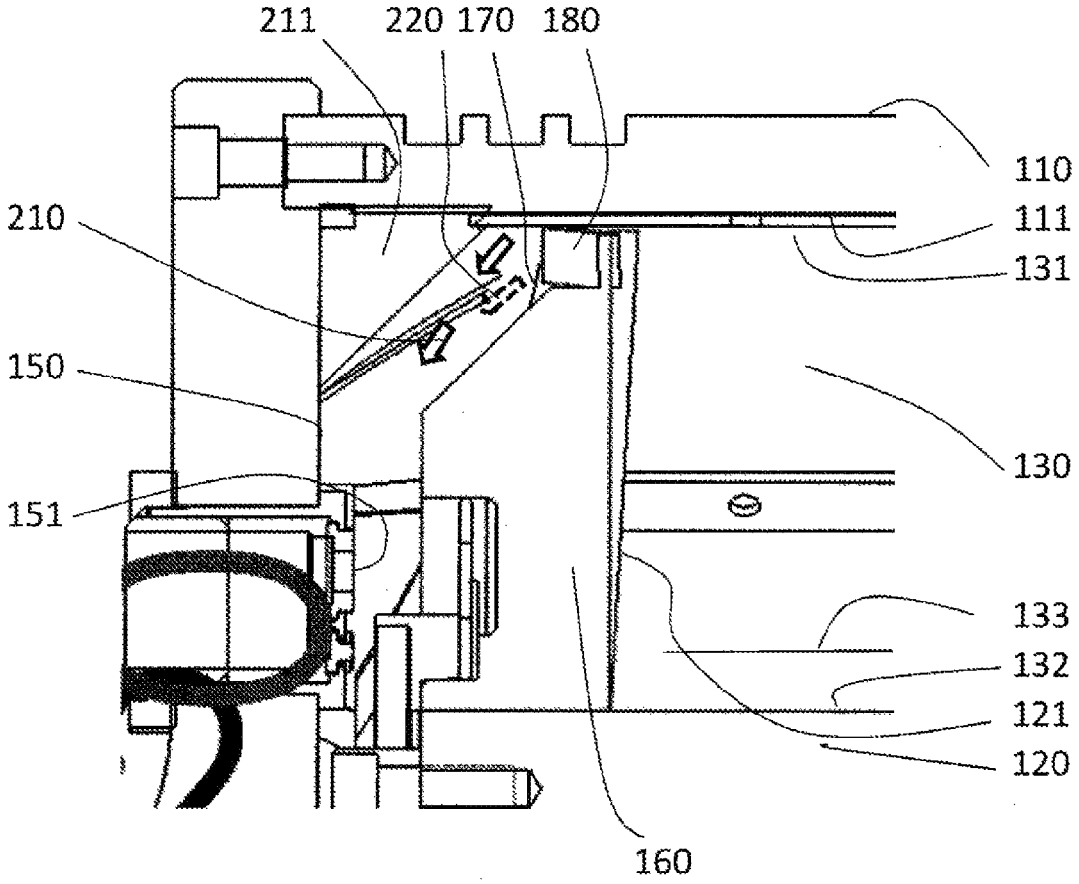
FIG. 7 is a cross-sectional view of a preferred embodiment of the present invention showing a chute having a flow assist structure.

Keeping with FIG. 1, and also looking at FIG. 7, the machine 100 has an outer bowl 110. The outer bowl comprises a cylinder 111 with an internal cylinder wall that is annular creating an annular volume of process material which is acted upon by elevated gravitational forces.

A conveyor 120 having flights 121 is also provided. The volume within the machine 100 between the cylinder 111 and the conveyor 120 defines a separation region 130 or pool. The separation region 130 has an outer diameter 131 adjacent the cylinder 111 of the outer bowl 110 and an inner diameter 132 adjacent the conveyor 120. The pool level 133 is defined as the depth of liquid within the separation region. In the preferred embodiment, the pool level is constant throughout the separation region.

A back drive system is provided for maintaining a difference in rotational speed between the outer bowl 110 and the conveyor 120. The difference in rotational speed causes the flights 121 of the conveyor to undergo a mechanical sweeping action within the separation region 130 to force the heavy phase liquid towards a head wall 150, which has a heavy phase discharge opening 151 there through. Opening 151 is commonly referred to as the solids discharge weir. Headwall 155 having a liquid discharge opening 156 is preferably opposite the heavy phase head wall 150.

In this regard, the lighter phase liquid flows across the inner annular surface of the pool volume and discharges through the openings 156 in the drive end headwall 155. The heavier phase liquid flows across the outer annular pool surface and underneath a solids baffle (described below) before turning radial and inward to discharge through the openings 151 in the feed tube end headwall 150. Dense grit material settles to the outer edge of the process volume before being swept by the conveyer axially at the scroll tips and pushing face of the conveyer to the solids baffle.

A solids baffle 160 is further provided according to the present invention, and it can best be seen in FIGS. 2-6. The solids baffle 160 is also a solids weir, but for sake of clarity, is referred to herein as a baffle. The solids baffle 160 extends radially away from machine central axis, and terminates a selected distance interior of the cylinder 111 of the outer bowl. The resulting annular space is the cross-sectional area that is perpendicular to the flow of the heavy phase liquid. The solids baffle 160 is spaced a selected distance inward from the head wall 150. Hence, looking specifically at FIG. 7, it is seen that a heavy phase flow path 210 extends from the separation region 130, between the solids baffle 160 and the cylinder 111 of the outer bowl, radially inward between the solids baffle 160 and the head wall 150, and out through the heavy phase discharge weir 151.

The solids baffle 160 preferably has a tapered distal end 161 terminating at an outer perimeter 162.

Several plows 170 are attached to the solids baffle 160. Each plow 170 has opposed ends 171 and 172, a face 173 and a tip 174. The face 173 is preferably inwardly convex and accordingly has an arcuate profile. Grit can be conveyed along the tips 174 of the plows 170.

Solids are conveyed along tip 174 in the inward radial direction away from the cylinder wall 111 and are tumbled into the flow path 210 of the heavy phase. This conveyance follows an arcuate path turn on the face 173 of the plow 170. The solids are resuspended within the heavy phase flow when projected from the plow, wherein they can be discharged through the heavy phase discharge opening 151. It is appreciated that the point of resuspension is located radially inward and accordingly at a smaller diameter. Accordingly, the gravitational forces at the point of resuspension are less than the gravitational forces at the bowl wall 111.

It is appreciated a preferred slicing angle is 60 degrees. While a slicing angle of 60 degrees is most preferred, an angle of 45 to 80 degrees is efficient, an angle of 25-45 degrees is less efficient, and an angle of 15-25 degrees is even less efficient but nevertheless is effective.

Four plows 170 are shown in the illustrated embodiment. However, it is appreciated that greater or fewer may be used without departing from the broad aspects of the present invention.

Wipers 180, having ends 181 and 182 are provided. Wipers 180 prevent blockage of the solids baffle. While four wipers 180 are shown, it is appreciated that greater or fewer wipers may be used without departing from the broad aspects of the present invention.

The wipers 180 maintain a constant area annular clearance by promoting the transport of settled material from the process annular volume across a restriction and into the discharge section of the heavy phase flow. Settled solids are transported across the axial length of the cylinder via the flights. The wipers 180 the transport the grit and other settled solids across the solids baffle to the plows 170 in grit path 220. The plows 170 then resuspend the grit and settled solids into the hydraulic flow path 210 of the heavy phase fluid.

By conveying, tumbling and resuspending the solids into the heavy phase flow behind the solids baffle 160, it is appreciated that a constant depth pool can be provided as a beach is not required. The capacity of the centrifugal machine can therefore be increased.

Figure 8:
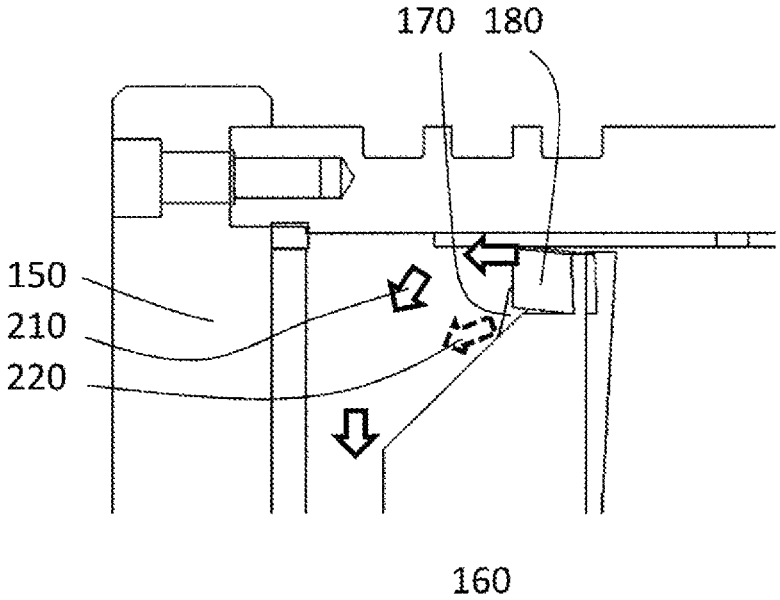
FIG. 8 is a cross-sectional view of a preferred embodiment of the present invention showing a chute with increased surge capacity.
Figure 9:
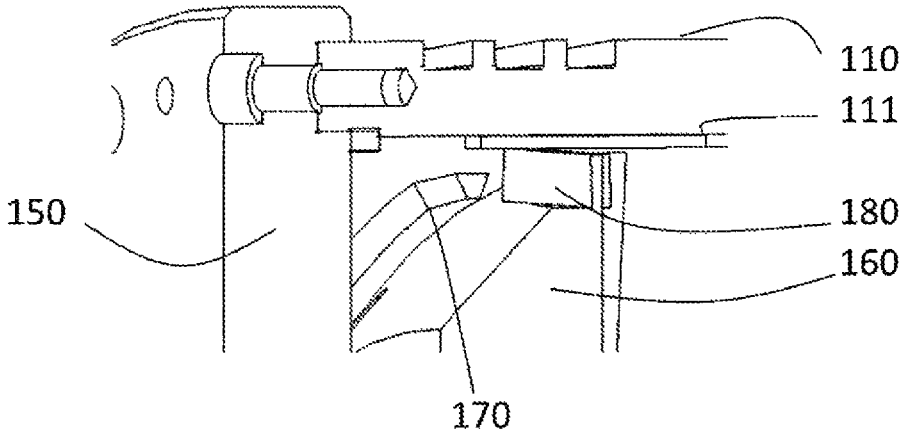
FIG. 9 is a perspective view showing a preferred location of the plow.
Figure 10A:
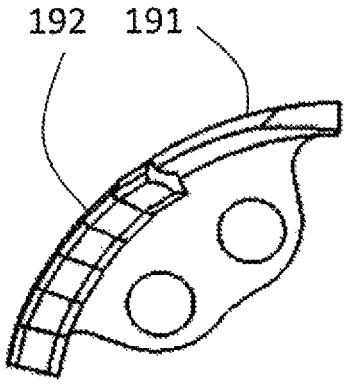
FIG. 10A is a perspective view of an alternative insert of the present invention.
Figure 10B:
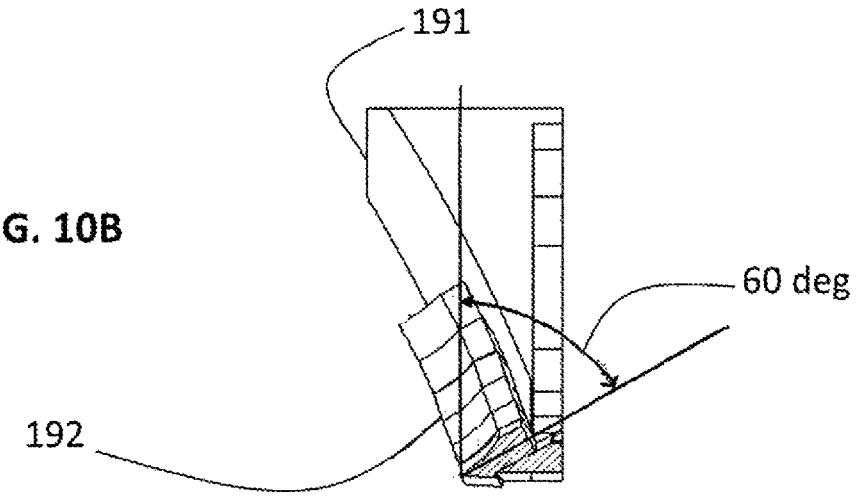
FIG. 10B is a perspective view showing a preferred slicing angle.
Figure 11:
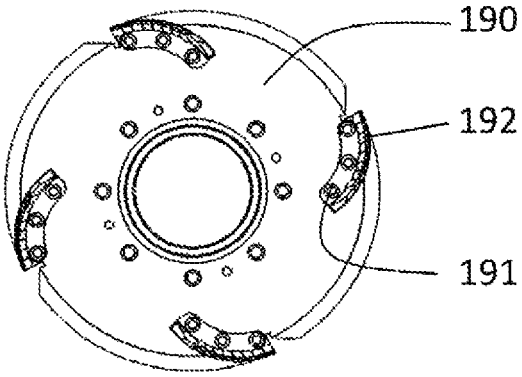
FIG. 11 is an end view of a solids baffle incorporating the insert of FIG. 10A.
Figure 12:
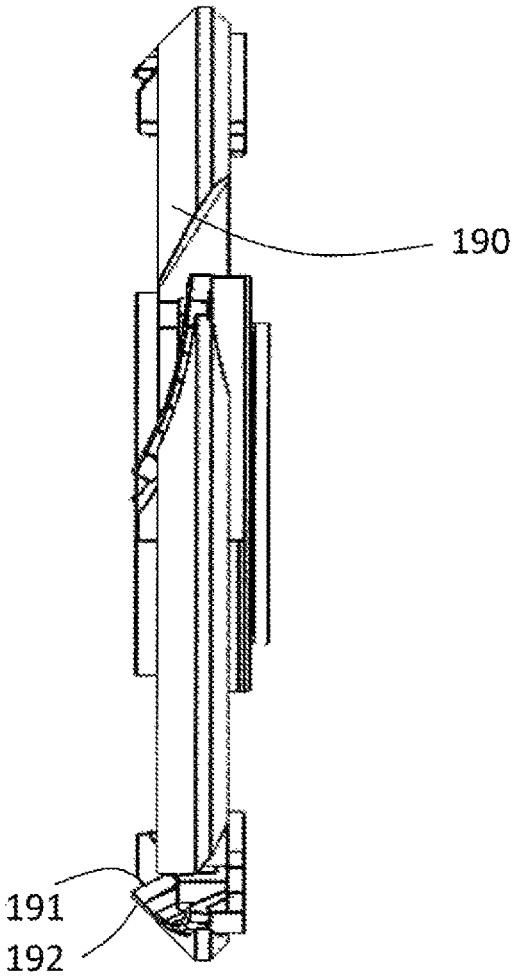
FIG. 12 is a side view of FIG. 11.

Comparing FIGS. 7 and 8, it is seen that two chute configurations can be provided. The chute can be configured for surge capacity or for flow assist. While configured for flow assist, an angled structure 211 can be provided within the flow path 210 to aid in the lifting of the heavy phase liquid.

Turning now to FIGS. 9-12, it is seen that an alternative preferred embodiment is illustrated. In particular, a solids baffle 190 with a removable insert 191 is shown. The insert 191 can have brazed on Sintered Tungsten Carbide tiles 192 mounted onto a harness which conforms to the double compound angle of the conveyance pathway. The tips of the tiles 192 preferably have a close clearance with the cylinder wall 111.

Figure 3:
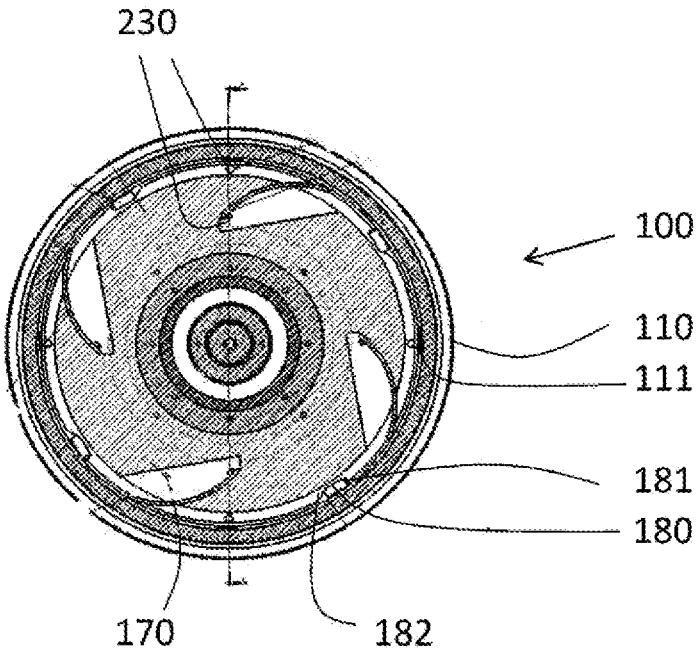
FIG. 3 is a cross-sectional view opposite of the view in FIG. 2.
Figure 4:
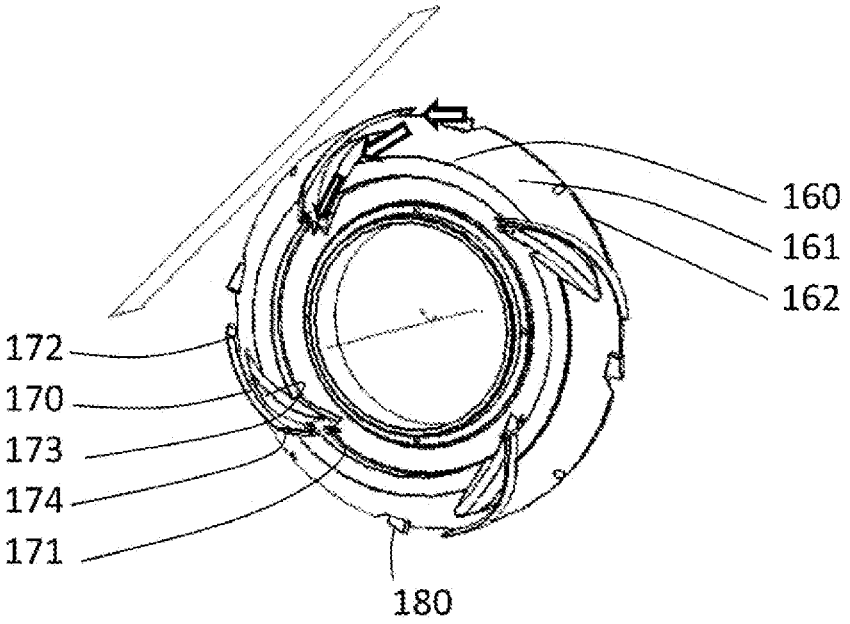
FIG. 4 is a perspective isolation view of a preferred embodiment of a solids baffle or the present invention.
Figure 5:
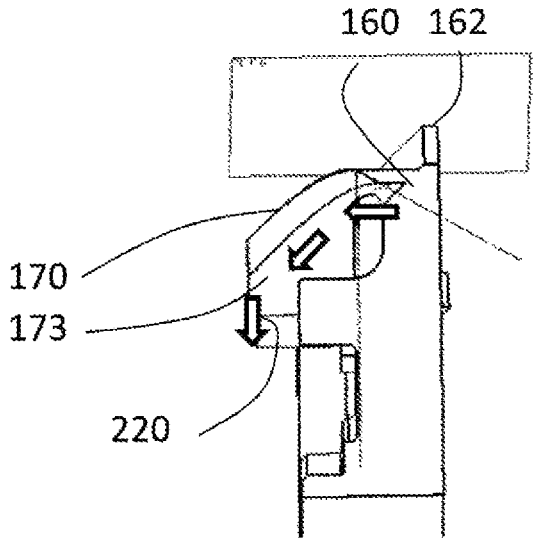
FIG. 5 is cross-sectional view of a preferred embodiment of the solids baffle.
Figure 6:
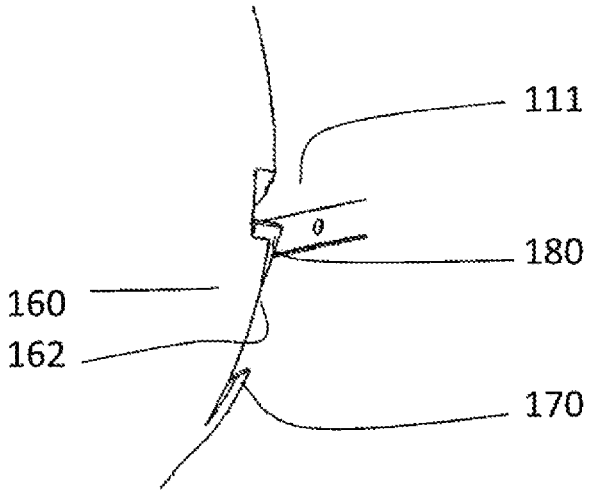
FIG. 6 is a close up view showing embodiments of a wiper and a plow adjacent the bowl wall.

Looking now again at FIG. 3, it is seen that air inlets 230 can optionally be introduced into the heavy phase flow path 210 to promote solids discharge via a pneumatic or hydraulic effect.

Thus it is apparent that there has been provided, in accordance with the invention, a centrifugal liquid separation machine that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A machine comprising:

an outer bowl;

a conveyor that is coaxial with said outer bowl said conveyor moving an amount of grit and other solids;

a solids baffle, said solids baffle having a distal end at an outer perimeter, a solids baffle first side and a solids baffle second side, said solids baffle having a tapered section at said distal end creating an enlarged gap between said solids baffle and a head wall;

a heavy phase flow path fully passing first between said outer bowl and said outer perimeter of said solids baffle at said distal end and second between said solids baffle second side and said head wall; and a plow on said solids baffle wherein at least a portion of said plow is located on said tapered section of said solids baffle, said plow extending away from said solids baffle second side and radially inward from said distal end, said plow resuspending said amount of grit and other solids away from said solids baffle second side into said heavy phase flow path as the heavy phase flow path passes between said plow and said head wall.

2. The machine of claim 1 wherein said plow lifts the amount of grit and other solids in a radially inward manner through a grit path and into said heavy phase flow path.

3. The machine of claim 2 wherein said plow has a slicing angle of between approximately 15 degrees to 80 degrees.

4. The machine of claim 3 wherein said plow has a slicing angle of approximately 60 degrees.

5. The machine of claim 1 wherein said plow has a face, and said face is inwardly convex.

6. The machine of claim 1 where said plow comprises four plows.

7. A machine comprising:

an outer bowl;

a head wall, said head wall being at one end of said outer bowl and having a heavy phase discharge opening there through, said heavy phase discharge opening being located inward of said outer bowl;

a conveyor that is coaxial with said outer bowl, said conveyor moving an amount of grit and other solids towards said head wall;

a solids baffle, said solids baffle having a distal end at an outer perimeter, a solids baffle first side and a solids baffle second side, said solids baffle having a tapered section at said distal end creating an enlarged gap between said solids baffle and said head wall;

a heavy phase flow path fully passing first between said outer bowl and said outer perimeter of said solids baffle, and second radially inward between said head wall and said solids baffle second side to said heavy phase discharge opening through said head wall; and a plow integrated with said solids baffle wherein at least a portion of said plow is located on said tapered section of said solids baffle, said plow extending away from said solids baffle second side and radially inward from said distal end, said plow lifting the amount of grit and other solids radially inward through a grit path and resuspending the amount of grit and other solids off from said plow and into said heavy phase flow path as the heavy phase flow path passes between said plow and said head wall.

8. The machine of claim 7 wherein said plow has a face, said face being inwardly convex to promote tumbling of the amount of grit and other solids in said grit path as the amount of grit and other solids are lifted radially inward into said heavy phase flow path.

9. The machine of claim 7 wherein said plow comprises four plows.

10. The machine of claim 9 further comprising removable inserts attached to each of said four plows, said inserts being selectably replaceable and said four plows being equally spaced about the solids baffle.

11. The machine of claim 7 further comprising a wiper, said wiper being at said outer perimeter of said solids baffle to transport grit and other solids across said solids baffle to said plow.

12. The machine of claim 11 wherein said wiper comprises four wipers.

13. The machine of claim 7 wherein said heavy phase flow path further passes through a chute after passing between said solids baffle and said outer bowl and before said heavy phase flow path passes through said heavy phase discharge opening.

14. The machine of claim 13 wherein said chute comprises an angled wall to assist flow through said chute.

15. A machine comprising:

an outer bowl;

a head wall, said head wall being at one end of said outer bowl and having a heavy phase discharge opening there through;

a conveyor that is coaxial with said outer bowl, said conveyor moving an amount of grit and other solids towards said head wall;

a solids baffle, said solids baffle having a distal end at an outer perimeter, a solids baffle first side and a solids baffle second side;

a heavy phase flow path fully passing between said outer bowl and said distal end at said outer perimeter of said solids baffle; and at least one wiper, said at least one wiper being connected to said solids baffle and maintaining a constant annular clearance between said solids baffle and said outer bowl and promoting transport across said solids baffle, wherein:

said machine further comprises four plows each integral with said solids baffle and extending away from said solids baffle second side and radially inward from said distal end to lift the amount of grit and other solids radially inward and into said heavy phase flow path; and said at least one wiper is aligned to transport the amount of grit and other solids to one of said four plows.

16. The machine of claim 15 wherein said at least one wiper comprises four wipers equally spaced about said solids baffle.

17. The machine of claim 15 wherein each of said four plows is inwardly convex to promote tumbling of the amount of grit and other solids along a grit path prior to resuspending the amount of grit and other solids into said heavy phase flow path.

18. A machine comprising:

an outer bowl;

a head wall, said head wall being at one end of said outer bowl and having a heavy phase discharge opening there through, said heavy phase discharge opening being located inward of said outer bowl;

a conveyor that is coaxial with said outer bowl, said conveyor moving an amount of grit and other solids towards said head wall;

a solids baffle, said solids baffle having an outer perimeter;

a heavy phase flow path passing between said outer bowl and said outer perimeter of said solids baffle, and radially inward to said heavy phase discharge opening through said head wall;

four plows, each of said four plows lifting the amount of grit and other solids radially inward through a grit path and into said heavy phase flow path; and a number of removable inserts attached to each of said four plows, said number of removable inserts being selectably replaceable and said four plows being equally spaced about the solids baffle.

19. A machine comprising:

an outer bowl;

a head wall, said head wall being at one end of said outer bowl and having a heavy phase discharge opening there through, said heavy phase discharge opening being located inward of said outer bowl;

a conveyor that is coaxial with said outer bowl, said conveyor moving an amount of grit and other solids towards said head wall;

a solids baffle, said solids baffle having a distal end at an outer perimeter, a solids baffle first side and a solids baffle second side;

a heavy phase flow path fully passing first between said outer bowl and said outer perimeter of said solids baffle, and second radially inward between said head wall and said solids baffle second side to said heavy phase discharge opening through said head wall;

a plow integrated with said solids baffle extending away from said solids baffle second side and radially inward from said distal end, said plow lifting the amount of grit and other solids radially inward through a grit path and resuspending the amount of grit and other solids off from said plow and into said heavy phase flow path as the heavy phase flow path passes between said plow and said head wall; and a wiper, said wiper being at said outer perimeter of said solids baffle to transport the amount of grit and other solids across said solids baffle to said plow.

* * * * *